US009079436B2

(12) United States Patent
Suzuki et al.

(10) Patent No.: US 9,079,436 B2
(45) **Date of Patent: *Jul. 14, 2015**

(54) PRINTING APPARATUS WITH CUTTER MECHANISM

(71) Applicant: Star Micronics Co., Ltd., Shizuoka (JP)

(72) Inventors: Yuji Suzuki, Shizuoka (JP); Masaaki Morishita, Shizuoka (JP)

(73) Assignee: STAR MICRONICS CO., LTD., Shizuoka-Shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/151,568

(22) Filed: Jan. 9, 2014

(65) Prior Publication Data

US 2014/0125000 A1 May 8, 2014

Related U.S. Application Data

(63) Continuation of application No. 12/968,764, filed on Dec. 15, 2010, now Pat. No. 8,702,331.

(30) Foreign Application Priority Data

Dec. 28, 2009 (JP) ..... 2009-297496

(51) Int. Cl.

| | |
|---|---|
| ***B41J 11/66*** | (2006.01) |
| ***B41J 11/70*** | (2006.01) |
| ***B26D 7/22*** | (2006.01) |

(Continued)

(52) U.S. Cl.

CPC ..... *B41J 11/70* (2013.01); *B26D 1/085* (2013.01); *B41J 11/0045* (2013.01); *B41J 15/042* (2013.01); *B26D 7/22* (2013.01); *B26D 2007/005* (2013.01)

(58) Field of Classification Search

CPC ..... B41J 11/66; B41J 11/70; B41J 11/0045; B41J 11/006; B26D 7/22; B26D 1/085

USPC ..... 400/621

See application file for complete search history.

(56) References Cited

U.S. PATENT DOCUMENTS

| | | | | |
|---|---|---|---|---|
| 6,508,600 | B1 * | 1/2003 | Nonaka | 400/621 |
| 8,702,331 | B2 * | 4/2014 | Suzuki et al. | 400/621 |

(Continued)

FOREIGN PATENT DOCUMENTS

| | | | |
|---|---|---|---|
| CN | 2011-92933 | Y | 2/2009 |
| CN | 2013-62040 | Y | 12/2009 |

(Continued)

OTHER PUBLICATIONS

Office Action issued in Chinese Patent Application No. 2010-10622477.5 dated Apr. 14, 2014.

(Continued)

*Primary Examiner* — Nguyen Ha

(74) *Attorney, Agent, or Firm* — Pearne & Gordon LLP

(57) ABSTRACT

A movable BF guide is provided in a movable-blade receiving area into which a movable blade slides along a fixed blade while being pressed against the fixed blade in a process of cutting recording paper. The movable-blade receiving area is blocked by the BF guide when the cutting process is not performed, thus preventing the entry of the end portion of the downstream connected recording paper into the movable-blade receiving area.

5 Claims, 10 Drawing Sheets

(51) Int. Cl.

| | |
|---|---|
| ***B26D 1/08*** | (2006.01) |
| ***B41J 11/00*** | (2006.01) |
| ***B41J 15/04*** | (2006.01) |
| *B26D 7/00* | (2006.01) |

(56) References Cited

U.S. PATENT DOCUMENTS

| | | | | |
|---|---|---|---|---|
| 2006/0008312 | A1* | 1/2006 | Sago et al. | 400/642 |
| 2007/0028739 | A1* | 2/2007 | Kawaguchi | 83/651 |
| 2007/0065217 | A1* | 3/2007 | Yoshioka | 400/621 |
| 2008/0199239 | A1* | 8/2008 | Kohira | 400/621 |
| 2009/0245915 | A1* | 10/2009 | Kawaguchi | 400/621 |
| 2009/0317163 | A1* | 12/2009 | Kohira et al. | 400/621 |

FOREIGN PATENT DOCUMENTS

| | | | | | |
|---|---|---|---|---|---|
| JP | 62-044471 | A | | 2/1987 | |
| JP | 62044471 | A | * | 2/1987 | B41J 11/36 |
| JP | 63-165164 | A | | 7/1988 | |
| JP | 63165164 | A | * | 7/1988 | B41J 11/66 |
| JP | 2003-025662 | A | | 1/2003 | |
| JP | 2005-335315 | A | | 12/2005 | |
| JP | 2008-168564 | A | | 7/2008 | |
| JP | 2008168564 | A | * | 7/2008 | B41J 11/70 |
| JP | 2009214556 | A | * | 9/2009 | B41J 11/70 |
| KR | 10-0879969 | B1 | | 1/2009 | |

OTHER PUBLICATIONS

Japanese Office action for JP 2009-297496 dated Aug. 6, 2013.

* cited by examiner

PRINTING APPARATUS WITH CUTTER MECHANISM

CROSS-REFERENCE TO RELATED APPLICATIONS

This application is a continuation of U.S. patent application Ser. No. 12/968,764 filed on Dec. 15, 2010, which is based on Japanese Patent Application No. 2009-297496 filed on Dec. 28, 2009. The contents of these applications are herein incorporated by reference in their entirety.

BACKGROUND OF THE INVENTION

1. Field of the Invention

The present invention relates to printing apparatuses with cutter mechanisms. More particularly, the present invention is suitable for a printing apparatus having a partial cutting function for partially cutting roll-type recording paper while leaving an uncut portion.

2. Description of the Related Art

FIG. 10 illustrates an example of the structure of a printing apparatus with a cutting mechanism according to the related art. As illustrated in FIG. 10, roll-type recording paper 100 is arranged such that the recording paper 100 extends through an area between a thermal head 10 of a printing mechanism and a platen roller 11 of a paper-feeding mechanism. The recording paper 100 is subjected to printing by the thermal head 10, and is conveyed by the platen roller 11 such that the recording paper 100 passes through an area between a fixed blade 12 and a movable blade 13 included in the cutter mechanism and is discharged to the outside through a discharge port 16 between a front cover 14 and a rear cover 15. When the distance of conveyance of the recording paper 100 reaches a predetermined distance, the platen roller 11 stops conveying the recording paper 100. In addition, the thermal head 10 stops printing and the recording paper 100 is cut by the cutter mechanism. More specifically, a cutter driving device 17 causes the movable blade 13 to slide toward the fixed blade 12 while the recording paper 100 is placed between the movable blade 13 and the fixed blade 12, thereby cutting the recording paper 100.

A printing apparatus is known which has a partial cutting function for leaving an uncut portion in the process of cutting the recording paper 100 in addition to a full cutting function for completely cutting the recording paper 100. In this type of printing apparatus, the movable blade 13 has a V-shaped cutting edge. The movable blade 13 moves toward the fixed blade 12 that is opposed to the movable blade 13 with the recording paper 100 placed therebetween, and slides along the fixed blade 12 while being pressed against the fixed blade 12. Accordingly, the recording paper 100 is gradually cut from the ends thereof in the width direction toward the center. In a partial cutting process, the sliding of the movable blade 13 is stopped immediately before an end portion of the V-shaped cutting edge at the center of the movable blade 13 reaches the fixed blade 12. In this case, a central portion of the recording paper 100 in the width direction is left uncut. In the cutter mechanism having the above-described structure, a movable-blade receiving area 18 having a width that is larger than or equal to the width of the movable blade 13 (larger than or equal to the width of the recording paper 100) is provided to receive the movable blade 13 that slides into along the fixed blade 12.

In the case where the recording paper 100 is partially cut, a portion of the recording paper 100 that is placed in the printing apparatus and that is to be subjected to printing next is partially connected to a portion of the recording paper that has been discharged to the outside of the printing apparatus through the discharge port 16 (hereinafter referred to as "downstream connected recording paper 101"). Therefore, unless the downstream connected recording paper 101 is removed by an operator, the next portion of the recording paper 100 is subjected to printing while the downstream connected recording paper 101 is partially connected thereto. In the following descriptions, the recording paper 100 and the downstream connected recording paper 101 that are partially connected to each other are called "continuous paper".

A leading end of the recording paper 100 that is to be subjected to printing next is at the position of the cutter mechanism (at the position of the fixed blade 12). Therefore, if the next printing operation is continuously performed from this state, a blank area having a dimension corresponding to the distance between the thermal head 10 and the fixed blade 12 is formed at the leading end of the recording paper 100. To reduce the wasted blank area in the recording paper 100, it is necessary to rotate the platen roller 11 in a reverse direction and convey the recording paper 100 backward (toward the upstream side in the conveying direction) before starting the next printing operation. The conveyance in this direction is hereinafter referred to as "backward feeding". FIG. 10 illustrates the state in which the recording paper 100 has been fed backward by a predetermined distance.

However, when the recording paper 100 is fed backward, the downstream connected recording paper 101, which has been subjected to the previous printing operation and is partially connected to the recording paper 100, is also fed backward together with the recording paper 100. At this time, a cut portion of the downstream connected recording paper 101 will possibly enter the movable-blade receiving area 18, undesirably causing a break of an end thereof. In addition, the downstream connected recording paper 101 will be possibly stuck in the movable-blade receiving area 18, undesirably causing a break of the uncut portion at which the downstream connected recording paper 101 is connected to the recording paper 100. Further, the downstream connected recording paper 101 will be possibly folded in an accordion style, undesirably causing a paper jam.

Accordingly, Japanese Unexamined Patent Application Publication No. 2005-335315 (hereinafter referred to as Patent Document 1), for example, proposes a printer in which spherical members for suppressing partially cut continuous paper from being raised are disposed downstream of the fixed blade in the conveying direction so that the continuous paper can be prevented from being damaged. According to the printer described in Patent Document 1, the continuous paper can be fed backward without causing a cut portion of base paper to curl and be caught by the fixed blade, and therefore the continuous paper can be prevented from being damaged.

However, the related art described in Patent Document 1 cannot completely eliminate the risk that the downstream connected recording paper 101 that is partially cut will enter the movable-blade receiving area 18 and be bent, the risk that the uncut portion at which the recording paper 100 is connected to the downstream connected recording paper 101 will break, and the risk that the downstream connected recording paper 101 will be folded in an accordion style and cause a paper. More specifically, there are large gaps and steps between the fixed blade and the spherical members. Therefore, in the case where, for example, a small-diameter paper roll in which paper is highly curved is used as the recording paper 100 or the recording paper 100 is deformed by being left in a low-temperature environment or a high-temperature, high-humidity environment, there is a high possibility that an end portion of the downstream connected recording paper 101 will enter the movable-blade receiving area 18 or be stuck in the movable-blade receiving area 18 during backward feeding.

Even if the backward feeding can fortunately be performed without causing an end portion of the downstream connected recording paper 101 to be stuck in the movable-blade receiving area 18, there is a risk that an end portion of the recording paper 100 will enter the movable-blade receiving area 18 and cause a paper jam when the recording paper 100 is conveyed forward (toward the downstream side in the conveying direction) by the platen roller 11 in the next printing operation. The conveyance in this direction is hereinafter referred to as "forward feeding".

SUMMARY OF THE INVENTION

The present invention has been made to solve the above-described problems, and an object of the present invention is to more reliably prevent the problem that an end portion of continuous paper including downstream connected recording paper that has been partially cut and is in a partially connected state will enter a movable-blade receiving area and be bent, the problem that an uncut portion will break, and the problem that a paper jam will occur when the continuous paper is fed backward or is fed forward after being fed backward.

To solve the above-described problems, according to the present invention, a movable paper-conveyance guiding member is provided in a movable-blade receiving area into which a movable blade slides in a process of cutting roll-type recording paper that is conveyed along a conveying path. The paper-conveyance guiding member guides the recording paper that is being conveyed with a projecting portion that projects toward the conveying path beyond a cutting edge of a fixed blade when the cutting process for cutting the recording paper is not performed. The paper-conveyance guiding member is moved away from the conveying path when the cutting process is performed.

According to the present invention, when the recording paper partially connected to the downstream recording paper with an uncut portion (continuous paper) is fed backward, the movable-blade receiving area is blocked such that the projecting portion of the paper-conveyance guiding member projects toward the conveying path. Therefore, even in the case where a small-diameter paper roll in which paper is highly curved is used as the recording paper or the recording paper is deformed by being left in a low-temperature environment or a high-temperature, high-humidity environment, the present configuration surely prevents the problem that the downstream connected recording paper that is being fed backward will enter the movable-blade receiving area and be bent, the problem that the uncut portion at which the recording paper is connected to the downstream connected recording paper will break, and the problem that the downstream connected recording paper will be folded in an accordion style and cause a paper jam. In addition, also when the recording paper (continuous paper) is fed forward after being fed backward in the next printing operation, the present configuration prevents the problem that the recording paper will enter the movable-blade receiving area and cause a paper jam.

DESCRIPTION OF THE PREFERRED EMBODIMENT

Figure 1A:
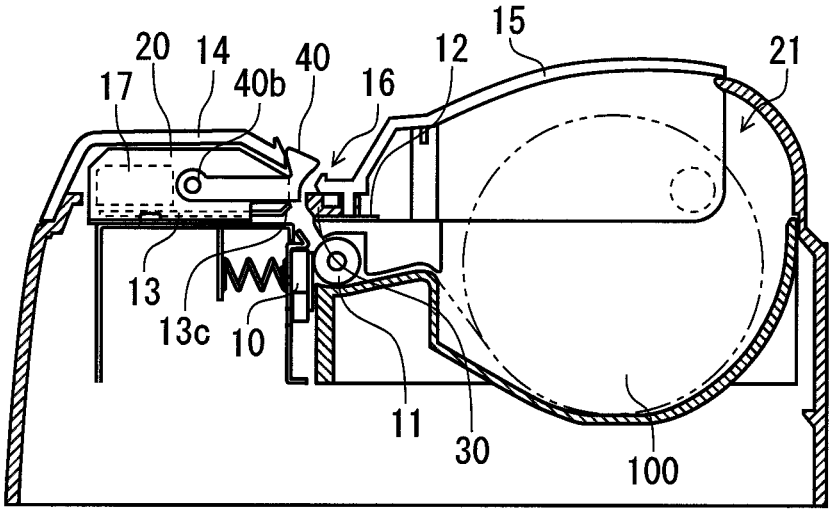
FIGS. 1A and 1B are diagrams illustrating an example of the overall structure of a printer according to an embodiment.
Figure 1B:
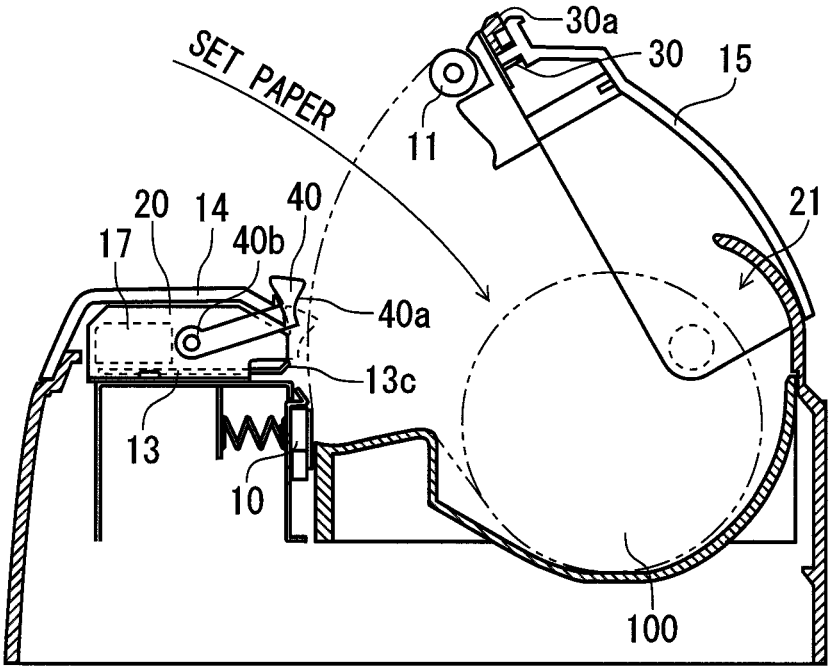
Figure 2:
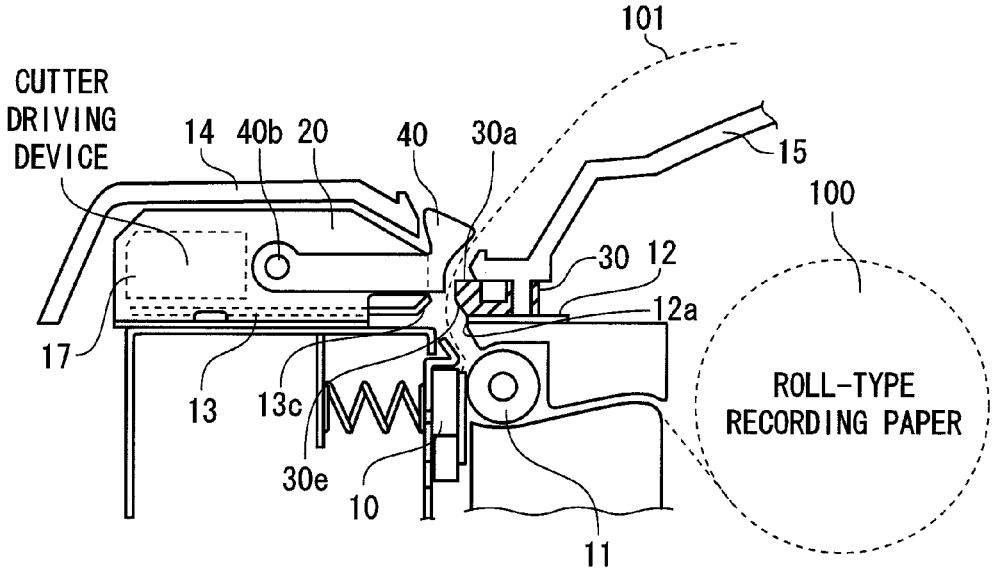
FIG. 2 is a diagram illustrating an example of the structure of the main part of the printer according to the embodiment.
Figure 10:
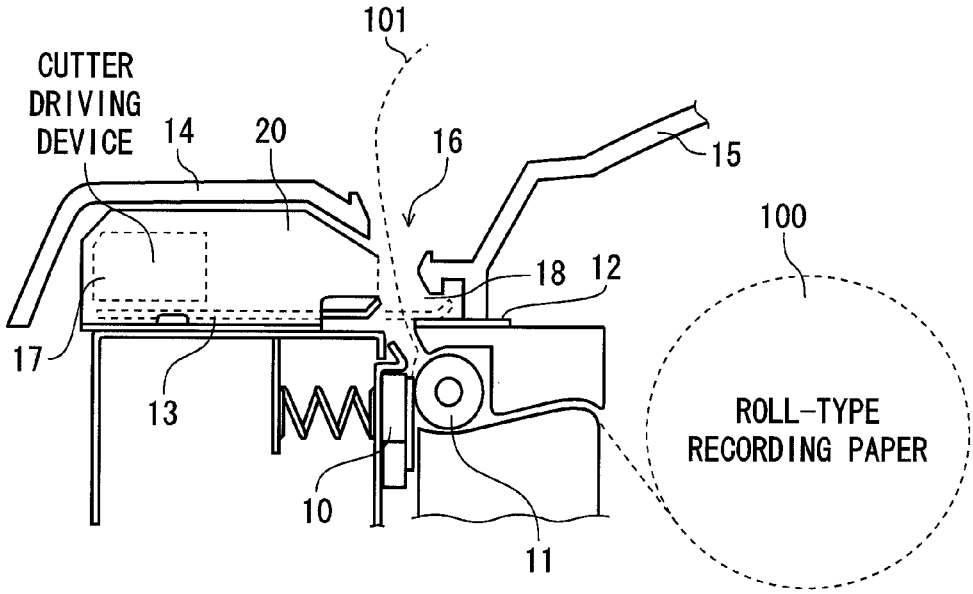
FIG. 10 PRIOR ART
FIG. 10 is a diagram illustrating an example of the structure of a printer according to the related art.

An embodiment of the present invention will be described with reference to the drawings. FIGS. 1A and 1B are diagrams illustrating an example of the overall structure of a printing apparatus (hereinafter referred to simply as a "printer") with a cutter mechanism according to the present embodiment. FIG. 2 is a diagram illustrating an example of the structure of the main part of the printer according to the present embodiment. FIG. 1A illustrates the state in which a rear cover 15 is closed and FIG. 1B illustrates the state in which the rear cover 15 is opened. In FIGS. 1A and 1B, components having the same functions as those of the components illustrated in FIG. 10 are denoted by the same reference numerals.

As illustrated in FIGS. 1A and 1B, the printer according to the present embodiment is a printing apparatus including a separate-type cutter mechanism in which a movable blade 13 is provided at a main body and a fixed blade 12 is provided at the rear cover 15. A platen roller 11 is also provided at the rear cover 15 together with the fixed blade 12. When the rear cover 15 is opened as illustrated in FIG. 1B, for example, to set recording paper 100, the platen roller 11 and the fixed blade 12 move together with the rear cover 15.

A paper storage section 21 is provided in the main body of the printer. Roll-type thermal recording paper 100 is stored in the paper storage section 21. The rear cover 15 is connected with a hinge to an upper portion of a rear section of the main body at one end thereof, and is pivotable so as to close the paper storage section 21, as illustrated in FIG. 1A.

As illustrated in FIG. 1B, a thermal head 10 that extends in a paper width direction of the recording paper 100 is disposed in front of the paper storage section 21 in the main body of the printer. The thermal head 10 is fixed such that a heating surface thereof faces backward (rightward in FIGS. 1A and 1B). The thermal head 10 corresponds to printing means according to the present invention. The platen roller 11 extends in the paper width direction of the recording paper 100, and is rotatably supported at a front end of the rear cover 15. In the state in which the rear cover 15 is closed, the platen roller 11 is pressed against the thermal head 10 at an appropriate pressure. In the present embodiment, the thermal head 10 and the platen roller 11 form a printing and paper-feeding mechanism.

A movable blade unit 20 that cuts the recording paper 100 in cooperation with the fixed blade 12 is disposed above the thermal head 10 and behind a front cover 14 of the main unit. The movable blade unit 20 includes the movable blade 13 which is installed to be reciprocable back and forth (in the left-right direction in FIGS. 1A and 1B) and a cutter driving device 17 that reciprocates the movable blade 13. FIGS. 1A and 1B illustrate the state in which the movable blade 13 is at a home position at which the movable blade 13 is farthest from the fixed blade 12. The fixed blade 12 is plate-shaped, and is disposed above the platen roller 11 such that the fixed blade 12 is parallel to the movable blade 13. The fixed blade 12 and the movable blade 13 form cutting means according to the present invention.

Figure 3A:
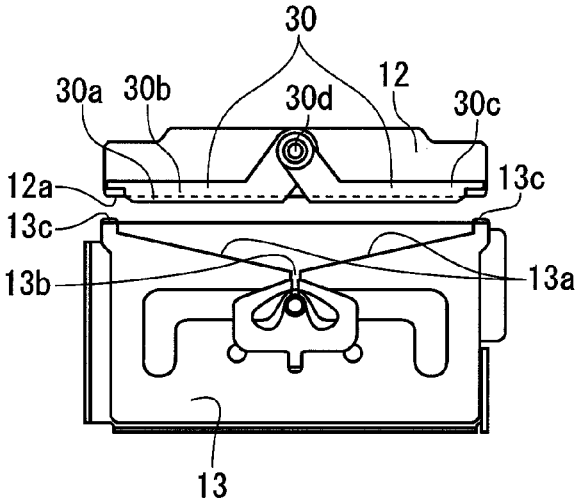
FIGS. 3A and 3B are diagrams illustrating an example of the structures of a fixed blade, a movable blade, and a BF guide included in the printer according to the embodiment.
Figure 3B:
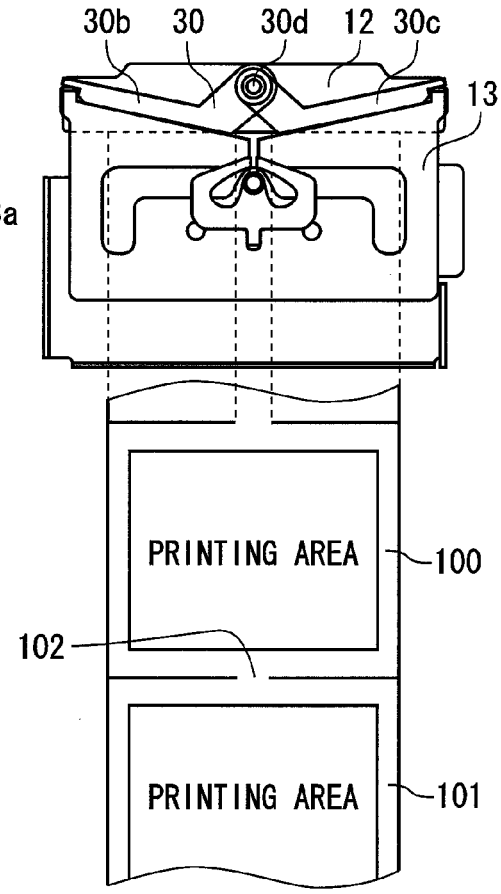

FIGS. 3A and 3B illustrate an example of the structures of the fixed blade 12 and the movable blade 13. The upper side in FIGS. 3A and 3B corresponds to the back side of the printer (right side in FIGS. 1A and 1B) and the lower side in FIGS. 3A and 3B corresponds to the front side of the printer (left side in FIGS. 1A and 1B). As illustrated in FIGS. 3A and 3B, the fixed blade 12 includes a blade portion 12*a* at a front edge thereof. The movable blade 13 includes a blade portion 13*a* at a back edge thereof. To achieve smooth cutting of the recording paper 100, the blade portion 13*a* is formed in a V-shape that is symmetrical in the left-right direction so as to project further backward from the center toward the ends. A recess 13*b* is formed at the center of the blade portion 13*a* so that, in a partial cutting process, an uncut portion 102 is formed and downstream connected recording paper 101 remains connected to the next portion of the recording paper 100.

Guide pieces 13*c* that project backward are provided at the ends of the back edge of the movable blade 13. The guide pieces 13*c* guide the movable blade 13 when the movable blade 13 slides onto the fixed blade 12 in the process of cutting the recording paper 100. When the movable blade 13 moves backward from the home position, the guide pieces 13*c* slide onto the fixed blade 12 before the blade portion 13*a* of the movable blade 13 comes into contact with the fixed blade 12. Accordingly, the blade portion 13*a* of the movable blade 13 smoothly slides onto the fixed blade 12 and the movable blade 13 reaches a cutting position.

Referring to FIGS. 1A and 1B again, in the state in which the rear cover 15 is closed, the recording paper 100 stored in the paper storage section 21 extends through an area between the thermal head 10 and the platen roller 11. A leading end portion of the recording paper 100 is caused to pass through an area between the fixed blade 12 and the movable blade 13 and is discharged through a discharge port 16 between the front cover 14 and the rear cover 15. This path corresponds to a conveying path along which the roll-type recording paper 100 is conveyed. The recording paper 100 is conveyed downstream or upstream along the conveying path by friction generated between the platen roller 11 and the thermal head 10 when the platen roller 11 is rotated.

The fixed blade 12 and the movable blade 13 are disposed so as to be opposed to each other across the conveying path. The fixed blade 12 is disposed so as to face the inner side (non-printing-surface side) of the recording paper 100 in a curled state, and the movable blade 13 is disposed so as to face the outer side (printing-surface side) of the recording paper 100 in a curled state. The movable blade 13 is at the home position when the process of cutting the recording paper 100 is not performed. In the process of cutting the recording paper 100, the movable blade 13 moves toward the fixed blade 12 so that the blade portion 13*a* of the movable blade 13 slides onto the blade portion 12*a* of the fixed blade 12, thereby cutting the recording paper 100 on the conveying path.

More specifically, in the process of cutting the recording paper 100, the movable blade 13 moves from the home position toward the fixed blade 12 that is opposed to the movable blade 13 with the recording paper 100 placed therebetween, and slides along the fixed blade 12 while being pressed against the fixed blade 12. Accordingly, the recording paper 100 is gradually cut from the ends thereof in the width direction toward the center. If the sliding of the movable blade 13 is stopped immediately before an end portion (recess 13*b*) of the V-shaped cutting edge at the center of the movable blade 13 reaches the fixed blade 12, the recording paper 100 can be partially cut such that the central portion thereof is left uncut.

In the present embodiment, a movable backward feed (BF) guide 30 is provided at the upper side (downstream side in the conveying direction) of the fixed blade 12 in a movable-blade receiving area into which the movable blade 13 slides in the process of cutting the recording paper 100. The BF guide 30 corresponds to a paper-conveyance guiding member according to the present invention. The BF guide 30 includes a projecting portion 30*a* that projects toward the conveying path beyond the blade portion 12*a* (cutting edge) of the fixed blade 12 when the process of cutting the recording paper 100 is not performed. The projecting portion 30*a* guides the conveyance of the recording paper 100. FIGS. 1A, 1B, and 2 illustrate the state in which the process of cutting the recording paper 100 is not performed and the BF guide 30 is at a home position.

More specifically, as illustrated in FIGS. 3A and 3B, the BF guide 30 includes two guide members 30*b* and 30*c* that extend leftward and rightward from the center and that are connected to each other with a rotation shaft 30*d* provided at the center. The two guide members 30*b* and 30*c* are pivotable around the rotation shaft 30*d* in the opposite directions with respect to each other. A torsion spring (not shown) is provided around the rotation shaft 30*d* at the center, and the projecting portion 30*a* is urged forward (downward in FIGS. 3A and 3B) so that the projecting portion 30*a* projects toward the conveying path beyond the cutting edge of the fixed blade 12 when the process of cutting the recording paper 100 is not performed. FIG. 3A illustrates the state in which the BF guide 30 is urged by the torsion spring and is at the home position.

In the process of cutting the recording paper 100, the BF guide 30 is moved away from the conveying path (upward in FIGS. 3A and 3B). More specifically, as illustrated in FIG. 3B, in the process of cutting the recording paper 100, the guide members 30*b* and 30*c* of the BF guide 30 are pushed by the movable blade 13 that slides in the movable-blade receiving area and are pivoted toward the opposite side of the conveying path. When the process of cutting the recording paper 100 is finished and the movable blade 13 returns to the home position thereof, the BF guide 30 also returns to the home position thereof by being urged by the torsion spring, as illustrated in FIG. 3A.

Although the torsion spring is used in this embodiment, the present invention is not limited to this. For example, coil springs may be provided at the back side (upper side in FIGS. 3A and 3B) of the two guide members 30*b* and 30*c* that extend leftward and rightward from the center. In addition, although the two guide members 30*b* and 30*c* of the BF guide 30 are individually pivotable around the rotation shaft 30*d* in this embodiment, the present invention is also not limited to this. For example, a guide member having an integral structure may be provided such that the guide member can be moved away from the conveying path.

As illustrated in FIG. 2, the BF guide 30 preferably includes an inclined surface 30*e* that is inclined from the projecting portion 30*a* formed at the downstream side in the conveying direction toward the fixed blade 12 at the upstream side in the conveying direction. The inclined surface 30*e* is formed such that an edge of the inclined surface 30*e* near the fixed blade 12 does not project toward the conveying path beyond the cutting edge of the fixed blade 12 even when the BF guide 30 is at the home position.

Figure 4:
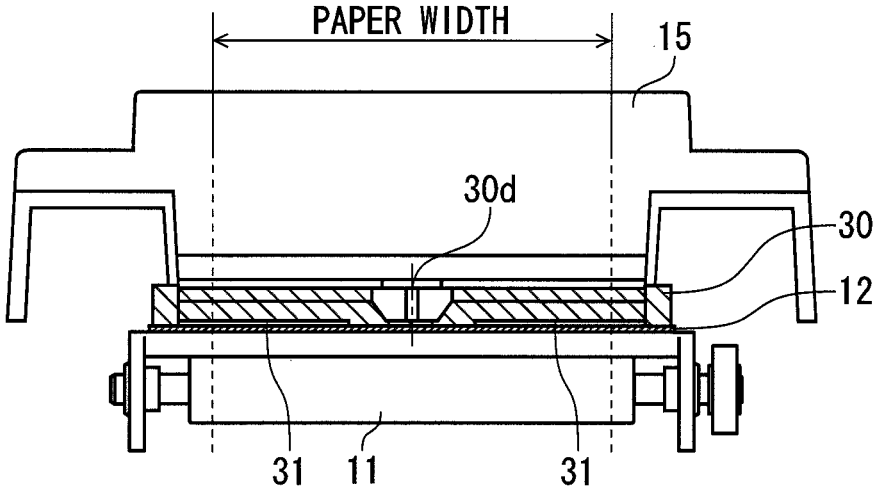
FIG. 4 is a diagram illustrating an example of the structure of a gap between the BF guide and the fixed blade according to the embodiment.

A small gap is preferably provided between the BF guide 30 and the fixed blade 12. A dimension of the gap in the thickness direction is somewhat larger than the maximum paper thickness of the recording paper 100 for which the operation of the printer can be guaranteed. FIG. 4 illustrates an example of the structure of this gap. As illustrated in FIG. 4, the BF guide 30 is moved while a central portion thereof around the rotation shaft 30*d* and end portions thereof are in contact with the fixed blade 12. A small gap 31 is preferably provided in an area where the BF guide 30 is not in contact with the fixed blade 12. A dimension of the gap 31 in the paper width direction is larger than the width of the recording paper 100, and a dimension of the gap 31 in the thickness direction is larger than the maximum thickness of the recording paper 100. The dimension of the gap 31 in the thickness direction is, for example, about several times the maximum thickness of the recording paper 100 for which the operation of the printer can be guaranteed. Since there is a possibility that end portions of the downstream connected recording paper 101 and the recording paper 100 connected thereto will enter the gap 31 in a folded state, the dimension of the gap 31 in the thickness direction is preferably somewhat larger than twice the maximum thickness of the recording paper 100.

As illustrated in FIGS. 1A, 1B, and 2, a discharge guide 40 is preferably provided downstream of the BF guide 30 in the conveying direction in the present embodiment. The discharge guide 40 corresponds to a paper-conveying-locus regulating member according to the present invention. The discharge guide 40 includes a curved surface 40*a* inclined from the upstream side toward the downstream side in the conveying direction. The curved surface 40*a* is formed such that a lower edge thereof at the upstream side in the conveying direction is on the movable-blade-13 side relative to the projecting portion 30*a* of the BF guide 30 at the home position and such that an upper edge thereof at the downstream side in the conveying direction is on the fixed-blade-12 side relative to the projecting portion 30*a* of the BF guide 30 at the home position. It is not necessary that the surface 40*a* be curved, and a flat inclined surface may be provided instead.

The discharge guide 40 is attached to the movable blade unit 20 in a pivotable manner. As illustrated in FIGS. 1A and 1B, the discharge guide 40 is pivoted in association with an operation of opening and closing the rear cover 15 so that the discharge guide 40 does not interfere with the platen roller 11 and other components when the rear cover 15 is being opened.

More specifically, when the rear cover 15 is closed as illustrated in FIG. 1A, the discharge guide 40 is pressed by a projection (not shown) provided on the rear cover 15 and is positioned on the conveying path of the recording paper 100. When the rear cover 15 is opened as illustrated in FIG. 1B, the discharge guide 40 is urged by a torsion spring (not shown) provided around a rotation shaft 40*b* of the discharge guide 40 and is pivoted upward.

Figure 5:
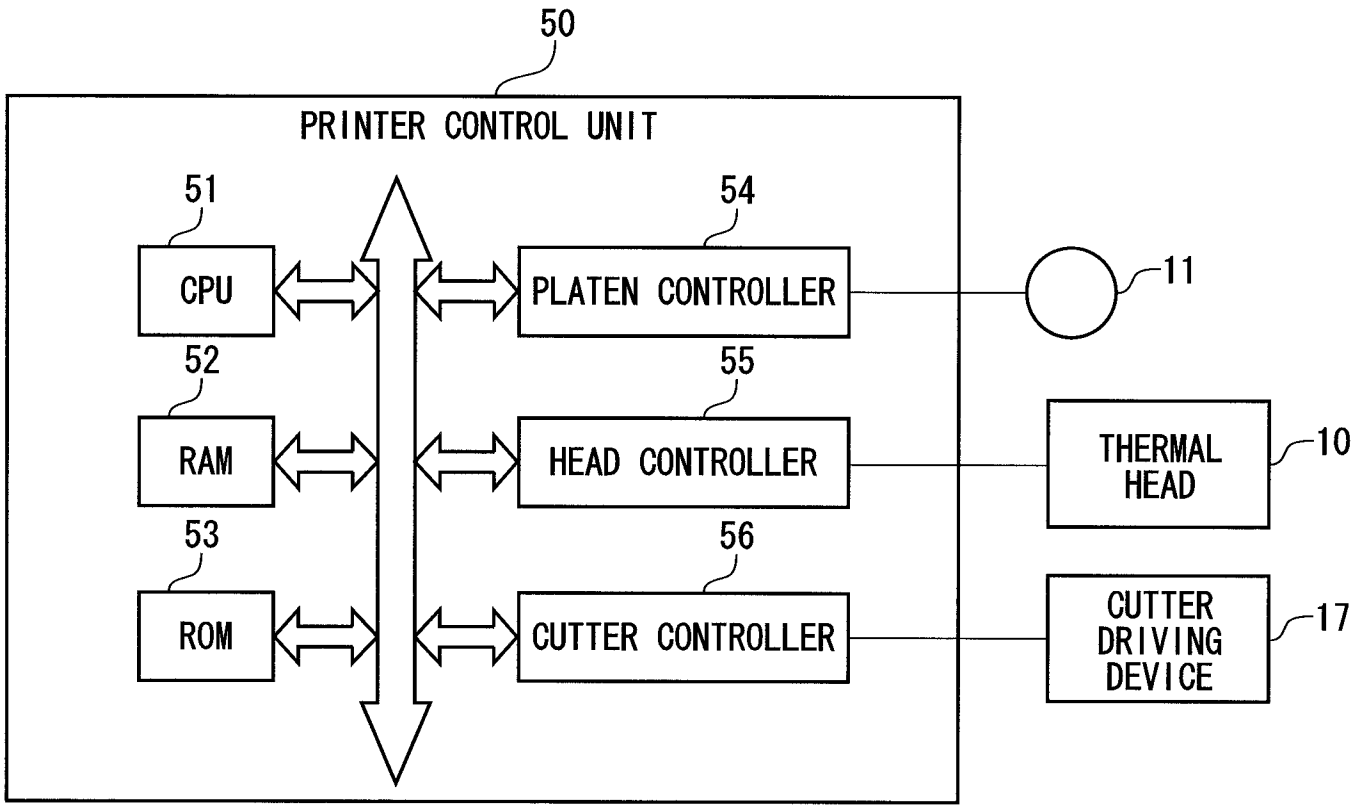
FIG. 5 is a block diagram illustrating an example of the structure of a printer control unit included in the printer according to the embodiment.

In the printer according to the present embodiment, the operations of printing on the recording paper 100, conveying the recording paper 100, moving the movable blade 13, etc., are controlled by a printer control unit 50 including a microcomputer. FIG. 5 is a block diagram illustrating an example of the structure of the printer control unit 50. As illustrated in FIG. 5, the printer control unit 50 includes a CPU 51, a RAM 52, a ROM 53, a platen controller 54, a head controller 55, and a cutter controller 56.

The CPU 51 controls the platen controller 54, the head controller 55, and the cutter controller 56 by operating in accordance with various programs stored in the ROM 53 while using the RAM 52 as a work memory. The ROM 53 stores various programs including a conveyance control program for controlling the platen controller 54, a printing control program for controlling the head controller 55, and a cutting control program for controlling the cutter controller 56.

The platen controller 54 is controlled by the CPU 51 on the basis of the conveyance control program to rotate the platen roller 11 to convey the recording paper 100 forward or backward. The platen controller 54 and the platen roller 11 correspond to conveying means according to the present invention. When the operation of printing on the recording paper 100 is started, the recording paper 100 is preferably fed forward (toward the downstream side in the conveying direction) by a first predetermined amount, and is then fed backward (toward the upstream side in the conveying direction) by a second predetermined amount. Then, during the operation of printing on the recording paper 100, the platen controller 54 continuously feeds the recording paper 100 forward (toward the downstream side in the conveying direction).

The reason why the recording paper 100 is fed backward is to start the printing operation after reducing the blank area at the leading end of the recording paper 100, the blank area having a dimension corresponding to a distance between the thermal head 10 and the fixed blade 12. More specifically, the leading end of the recording paper 100 to be subjected to printing is moved closer to the thermal head 10 by feeding the recording paper 100 backward. The second predetermined amount by which the recording paper 100 is fed backward is the amount necessary to reduce the dimension of the blank area to a desired dimension. The second predetermined amount depends on the structure of the printer.

Next, the reason why the recording paper 100 is preferably fed forward before feeding the recording paper 100 backward will be discussed. Immediately after the partial cutting process, there is a possibility that an end portion of the downstream connected recording paper 101 is caught in the gap 31 between the fixed blade 12 and the BF guide 30. If the recording paper 100 is fed backward from this state, there is a risk that the downstream connected recording paper 101 will be caught by the fixed blade 12.

In the present embodiment, the BF guide 30 is provided in the movable-blade receiving area in which the movable blade 13 moves onto the fixed blade 12 and slides along the fixed blade 12 in the process of cutting the recording paper 100. The BF guide 30 moves away from the conveying path of the recording paper 100 so as not to interfere with the movement of the movable blade 13. However, in the partial cutting process, there is a possibility that the end portion of the downstream connected recording paper 101 will be dragged by the movable blade 13 into the gap 31 between the fixed blade 12 and the BF guide 30. Therefore, the recording paper 100 is fed forward before starting the printing operation to pull out the end portion of the downstream connected recording paper 101 from the gap 31. The first predetermined amount by which the recording paper 100 is fed forward is set to an amount necessary to reliably cause the end portion of the downstream connected recording paper 101 to be brought onto the inclined surface 30*e* of the BF guide 30.

Thus, according to the present embodiment, the recording paper is fed forward before backward feeding, so that the end portion of the downstream connected recording paper that is connected to the recording paper is moved away from the fixed blade. Therefore, the recording paper is prevented from being fed backward while the downstream connected recording paper is caught by the fixed blade. As a result, when the recording paper is fed backward, the risk that the downstream connected recording paper connected to the recording paper will be caught by the fixed blade and be bent, the risk that the uncut portion at which the recording paper is connected to the downstream connected recording paper will break, and the risk that the downstream connected recording paper will be folded in an accordion style and cause a paper jam, can be reliably reduced or eliminated.

The time at which the recording paper 100 is fed forward and then backward is not limited to when the operation of printing on the recording paper 100 is started. The forward and backward feeding may be performed during the time from when the recording paper 100 is cut to when the next printing operation is started.

In the present embodiment, the small gap 31 is intentionally provided between the fixed blade 12 and the BF guide 30. The end portion of the downstream connected recording paper 101 is possibly dragged by the movable blade 13 and thereby stuck between the fixed blade 12 and the BF guide 30 in the partial cutting process. If the gap 31 is not provided, the end portion could not be pulled out even when the recording paper 100 to which the downstream connected recording paper 101 is connected is fed forward. In such a case, the uncut portion 102 at which the downstream connected recording paper 101 is connected to the next portion of the recording paper 100 will break and the downstream connected recording paper 101 will be jammed. Such a paper jam can be prevented by providing the gap 31 between the fixed blade 12 and the BF guide 30 and feeding the recording paper 100 forward before feeding the recording paper 100 backward.

The head controller 55 is controlled by the CPU 51 on the basis of the printing control program to generate control signals corresponding to print data such as characters, symbols, and bar codes stored in the RAM 52. The head controller 55 supplies the generated control signals to the thermal head 10 and causes the thermal head 10 to perform the printing operation. The cutter controller 56 is controlled by the CPU 51 on the basis of the cutting control program to move the movable blade 13 back and forth to cut (fully or partially) the recording paper 100 at a predetermined position.

Figure 6:
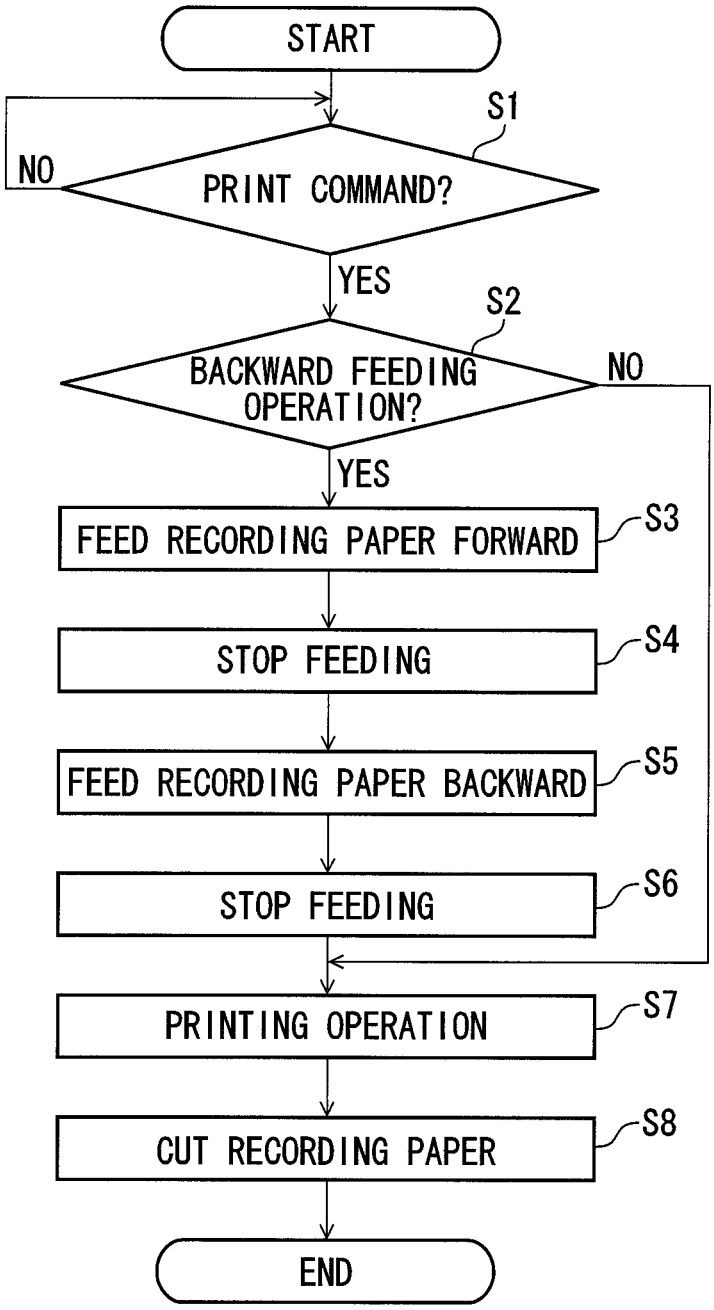
FIG. 6 is a flowchart illustrating an example of an operation performed by the printer control unit according to the embodiment.

Next, the operation of the printer according to the present embodiment having the above-described structure will be explained. FIG. 6 is a flowchart illustrating an example of an operation performed by the printer control unit 50 according to the present embodiment. FIGS. 7A to 7D are diagrams illustrating an operation of conveying the recording paper 100 in the printer according to the present embodiment. The flowchart illustrated in FIG. 6 is started when the operation of printing on the recording paper 100 is started.

Referring to FIG. 6, the CPU 51 in the printer control unit 50 determines whether or not a print command has been issued (step S1). If the CPU 51 determines that the print command has been issued, the CPU 51 determines whether or not a backward feed command is included in the print command (step S2). In the present embodiment, a user can set the printer to a mode for reducing the blank area in the recording paper 100 by operating an operation unit (not shown) of the printer. When this mode is set, the backward feed command is included in the print command.

If the CPU 51 determines that the backward feed command is included in the print command, the CPU 51 controls the platen controller 54 so as to feed the recording paper 100 forward (step S3), and stops the conveyance of the recording paper 100 when the amount of forward feeding reaches the first predetermined amount (step S4). Accordingly, the state of the continuous paper including the recording paper 100 and the downstream connected recording paper 101 changes from the state illustrated in FIG. 7A to the state illustrated in FIG. 7B.

Figure 7A:
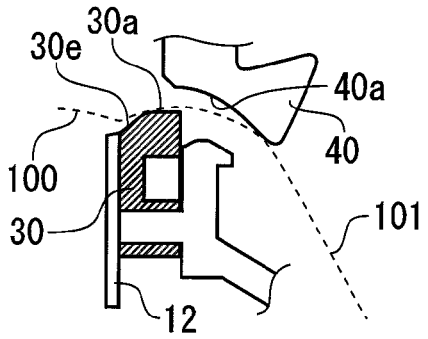
FIGS. 7A to 7D are diagrams illustrating an operation of conveying recording paper in the printer according to the embodiment.

FIG. 7A illustrates the state immediately after the partial cutting process. In this state, the downstream connected recording paper 101 that has been subjected to the previous printing operation is connected to the recording paper 100 that is to be subjected to the current printing operation. As illustrated in FIG. 7A, a trailing-end portion (portion at the upstream side in the conveying direction) of the downstream connected recording paper 101 is raised by the projecting portion 30*a* of the BF guide 30 so as to be brought toward the conveying path beyond the fixed blade 12 along the inclined surface 30*e* of the BF guide 30.

In addition, the conveying locus of the paper is regulated by the curved surface 40*a* of the discharge guide 40 that is inclined in a direction (toward the lower right in FIG. 7A) that is opposite to the direction of inclination (toward the upper right in FIG. 7A) of the inclined surface 30*e* of the BF guide 30. The conveying locus of the paper is limited such that a leading-end portion (portion at the downstream side in the conveying direction) of the downstream connected recording paper 101 is directed in a direction opposite to the direction in which the projecting portion 30*a* projects. Therefore, the end portion of the downstream connected recording paper 101 at the trailing end (the cut end portion that is connected to the recording paper 100) is bounced toward the conveying path, and is separated from the fixed blade 12.

Figure 7B:
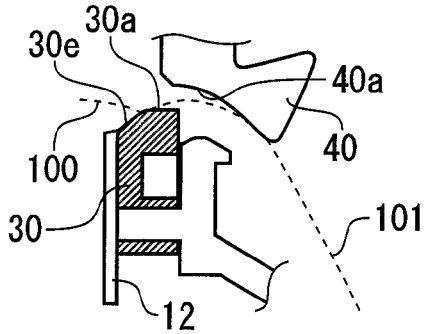
Figure 7C:
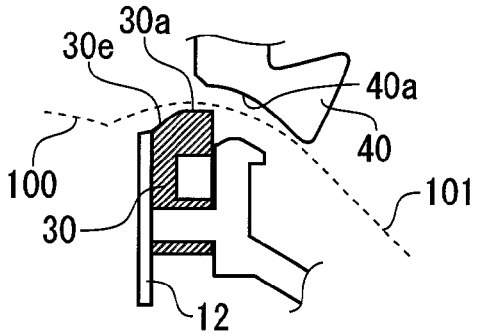

FIG. 7B illustrates the state in which the recording paper 100 has been fed forward by the first predetermined amount. The downstream connected recording paper 101, which is connected to the recording paper 100, is also fed forward together with the recording paper 100. When the continuous paper including the recording paper 100 and the downstream connected recording paper 101 is fed forward, the cut end portion at the trailing end of the downstream connected recording paper 101 moves away from the fixed blade 12. In addition, the cut end portion moves onto the inclined surface 30*e* of the BF guide 30, thereby moving further away from the fixed blade 12.

As described above, since the BF guide 30 and the discharge guide 40 are provided, when the partial cutting process is performed, the cut end portion of the downstream connected recording paper 101 at the trailing end is separated from the fixed blade 12, as illustrated in FIG. 7A, in most cases. Therefore, even when the recording paper 100 is directly fed backward from this state to reduce the blank area in the recording paper 100, the downstream connected recording paper 101 can be prevented from being bent by being caught by the fixed blade 12 or causing a paper jam.

In contrast, if the recording paper 100 is fed forward before feeding the recording paper 100 backward, as illustrated in FIG. 7B, the cut end portion of the downstream connected recording paper 101 at the trailing end is further separated from the fixed blade 12. Therefore, the downstream connected recording paper 101 can be more reliably prevented from being caught by the fixed blade 12 during backward feeding.

For example, even in the case where a small-diameter paper roll in which paper is highly curved is used as the recording paper 100 or the recording paper 100 is deformed into a highly curved shape by being left in a low-temperature environment or a high-temperature, high-humidity environment, the downstream connected recording paper 101 can be prevented from being caught by the fixed blade 12 during backward feeding. In addition, even if the cut end portion of the downstream connected recording paper 101 enters the gap 31 between the fixed blade 12 and the BF guide 30 in the partial cutting process, the cut end portion of the downstream connected recording paper 101 can be pulled out to the inclined surface 30*e* of the BF guide 30 by performing forward feeding. Therefore, the downstream connected recording paper 101 can be prevented from being caught by the fixed blade 12 during backward feeding performed after the forward feeding.

After the forward feeding of the recording paper 100 is stopped in step S4, the CPU 51 controls the platen controller 54 so as to feed the recording paper 100 backward (step S5), and stops the conveyance of the recording paper 100 when the amount of backward feeding reaches the second predetermined amount (step S6). Accordingly, the state of the continuous paper changes from the state illustrated in FIG. 7B to the state illustrated in FIG. 7C. Thus, preparation for the operation of printing on the recording paper 100 is completed.

Figure 7D:
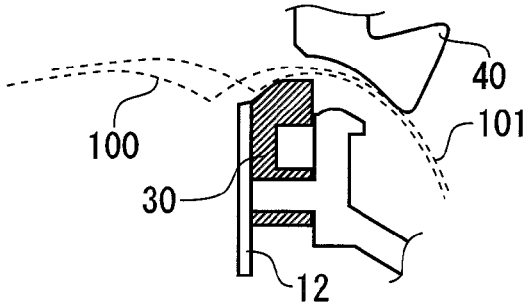

Next, the head controller 55 causes the thermal head 10 to generate heat at a predetermined position while the platen controller 54 feeds the recording paper 100 forward at a predetermined speed, so that color is developed in a thermal layer of the recording paper 100 (step S7). FIG. 7D illustrates the state in which the recording paper 100 is being fed forward in the printing operation. As illustrated in FIG. 7D, the BF guide 30 includes the inclined surface 30*e* that is inclined such that the height thereof increases toward the downstream side in the conveying direction. Therefore, even when the recording paper 100 is fed forward in the printing operation after being fed backward, the recording paper 100 moves onto the inclined surface 30*e* and is smoothly conveyed without being caught by the BF guide 30.

Then, when the printing operation is completed, the cutter controller 56 controls the movement of the movable blade 13 so as to cut (fully or partially) the recording paper 100 (step S8). If the CPU 51 determines that the backward feed command is not included in the print command in step S2, the process jumps to step S7.

As described in detail above, according to the present embodiment, the BF guide 30 is provided in an area entered by the movable blade 13 in the process of cutting the recording paper 100. When the process of cutting the recording paper 100 is not performed, the projecting portion 30*a* projects toward the conveying path beyond the cutting edge of the fixed blade 12 to guide the conveyance of the recording paper 100.

According to the above-described embodiment, when backward feeding is performed while the downstream connected recording paper 101 that has been partially cut is connected to the recording paper 100 to be subjected to printing next, the movable-blade receiving area is blocked such that the projecting portion 30*a* of the BF guide 30 projects toward the conveying path. Therefore, even in the case where a small-diameter paper roll in which the paper is highly curved is used as the recording paper 100 or the recording paper 100 is deformed by being left in a low-temperature environment or a high-temperature, high-humidity environment, the present structure surely prevents the problem that the downstream connected recording paper 101 that is being fed backward will enter the movable-blade receiving area and be bent, the problem that the uncut portion 102 at which the recording paper 100 is connected to the downstream connected recording paper 101 will break, and the problem that the downstream connected recording paper 101 will be folded in an accordion style and cause a paper jam. In addition, when the recording paper 100 is fed forward after being fed backward in the next printing operation, the present configuration prevents the problem that the recording paper 100 will enter the movable-blade receiving area and cause a paper jam.

In addition, according to the present embodiment, when the operation of printing on the recording paper 100 is started, the recording paper 100 is fed forward toward the downstream side in the conveying direction before feeding the recording paper 100 backward toward the upstream side in the conveying direction to reduce the blank area. Accordingly, the cut end portion of the downstream connected recording paper 101 at the trailing end is separated from the fixed blade 12. Therefore, the downstream connected recording paper 101 can be more reliably prevented from being caught by the fixed blade 12 during backward feeding.

In addition, according to the present embodiment, the discharge guide 40 is provided in addition to the BF guide 30. The discharge guide 40 serves to separate the cut end portion of the downstream connected recording paper 101 at the trailing end from the fixed blade 12. Therefore, the downstream connected recording paper 101 can be reliably prevented from being caught by the fixed blade 12 during backward feeding. Even when the discharge guide 40 is not provided, a certain effect can be provided by feeding the recording paper 100 forward before feeding the recording paper 100 backward. However, when the discharge guide 40 is provided, the downstream connected recording paper 101 can be more reliably prevented from being caught by the fixed blade 12 during backward feeding.

In the above-described embodiment, the BF guide 30 is moved back and forth by the operations of the movable blade 13 that slides into the movable-blade receiving area and the torsion spring that urges the BF guide 30. However, the present invention is not limited to this. For example, the torsion spring that urges the BF guide 30 may be omitted and the BF guide 30 may be moved by an actuator (not shown) provided in the printer.

Figure 8:
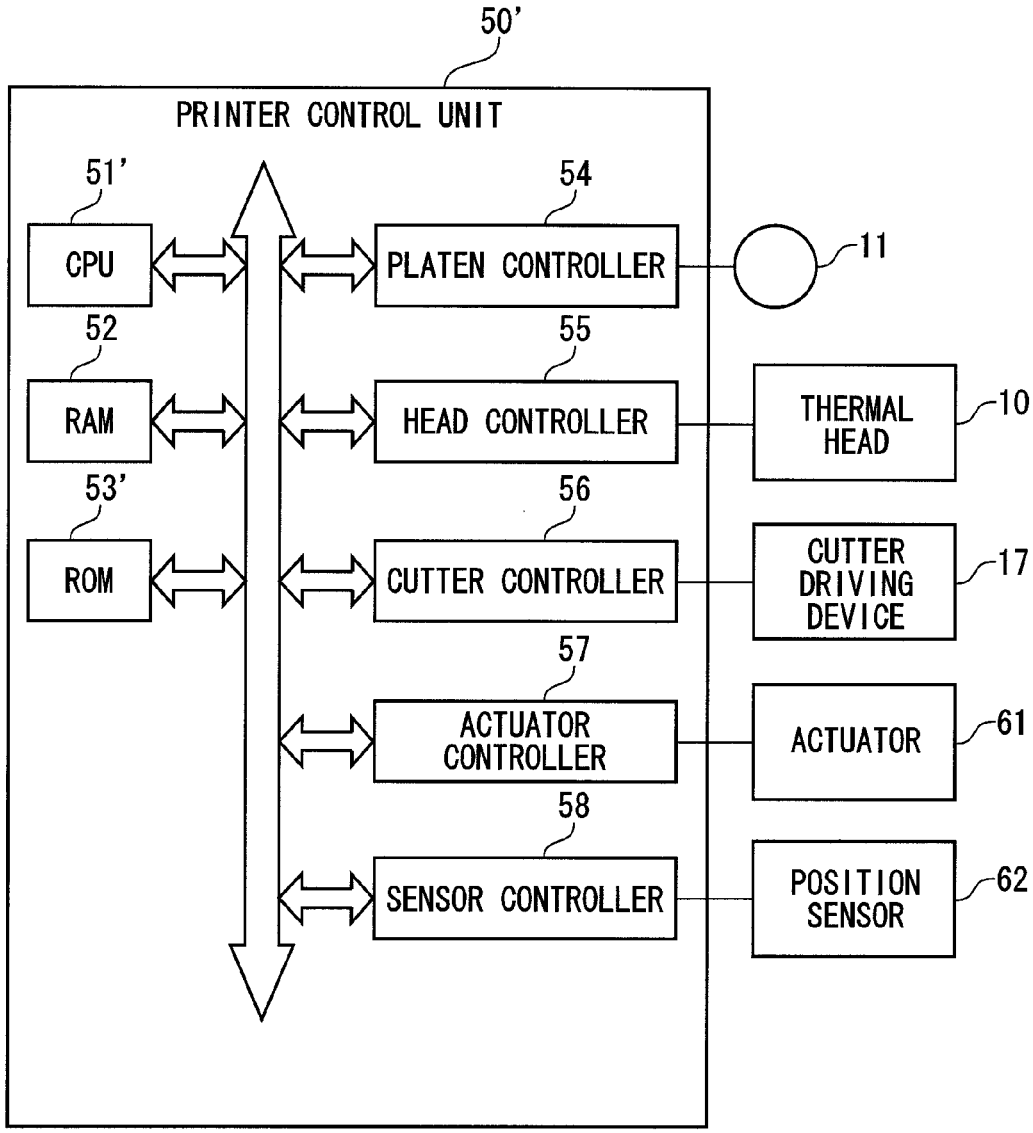
FIG. 8 is a block diagram illustrating an example of the structure of a printer control unit according to the embodiment in the case where the BF guide is moved by an actuator.

FIG. 8 is a block diagram illustrating an example of the structure of a printer control unit 50' in the case where the BF guide 30 is moved by the actuator. In FIG. 8, components having the same functions as those of the components illustrated in FIG. 5 are denoted by the same reference numerals, and explanations thereof are thus omitted.

Referring to FIG. 8, a CPU 51' controls the platen controller 54, the head controller 55, the cutter controller 56, an actuator controller 57, and a sensor controller 58 by operating in accordance with various programs stored in a ROM 53' while using the RAM 52 as a work memory.

The ROM 53' stores various programs including a conveyance control program for controlling the platen controller 54, a printing control program for controlling the head controller 55, a cutting control program for controlling the cutter controller 56, an actuator control program for controlling the actuator controller 57, and a position detection control program for controlling the sensor controller 58.

The actuator controller 57 is controlled by the CPU 51' on the basis of the actuator control program to drive a DC motor in an actuator 61 to move the BF guide 30. The sensor controller 58 is controlled by the CPU 51' on the basis of the position detection control program to detect the position of the BF guide 30 on the basis of a position signal output from a position sensor 62.

Figure 9:
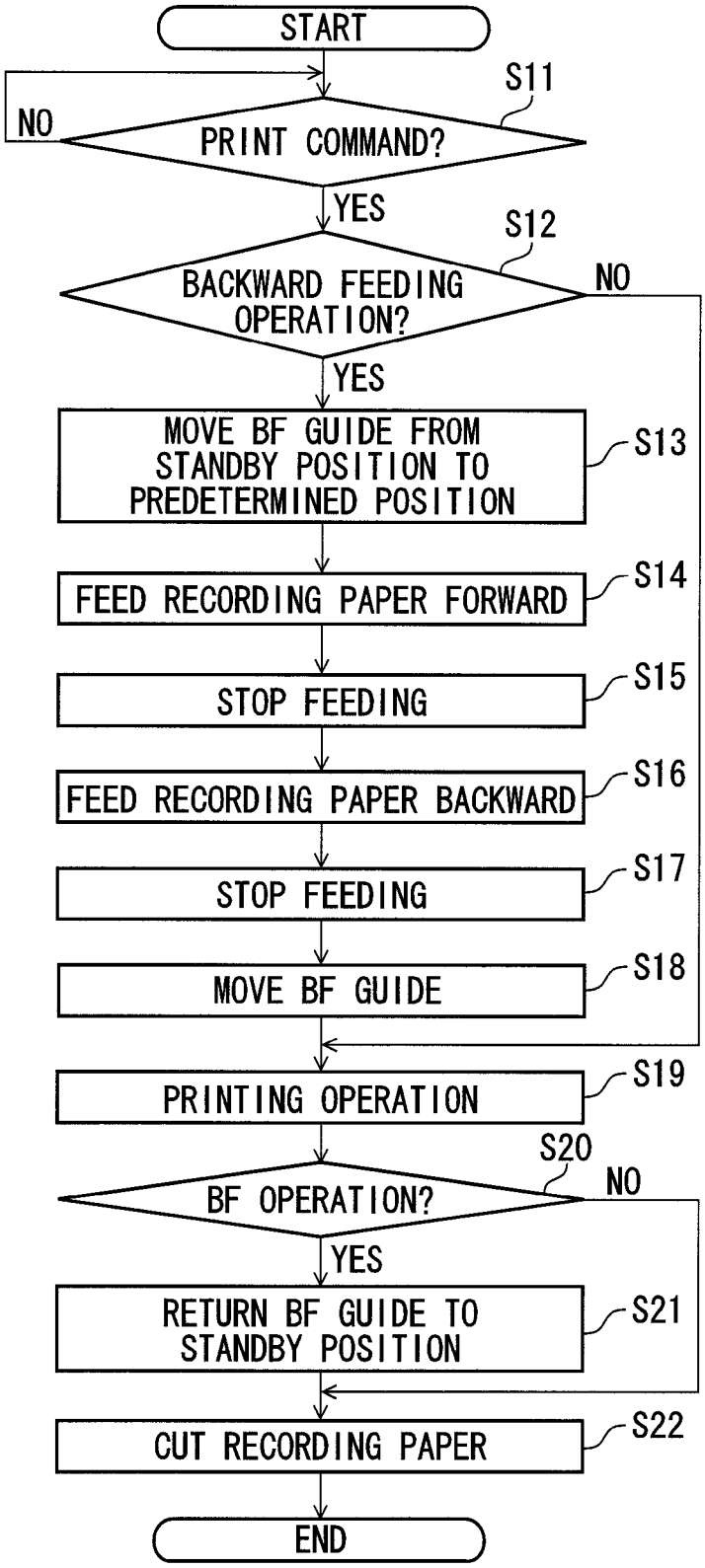
FIG. 9 is a flowchart illustrating an example of an operation performed by the printer control unit according to the embodiment in the case where the BF guide is moved by the actuator.

FIG. 9 is a flowchart illustrating an example of an operation performed by the printer control unit 50' according to the present embodiment in the case where the BF guide 30 is moved by the actuator 61. The flowchart illustrated in FIG. 9 is started when the operation of printing on the recording paper 100 is started.

Referring to FIG. 9, the CPU 51' in the printer control unit 50' determines whether or not a print command has been issued (step S11). If the CPU 51' determines that the print command has been issued, the CPU 51' determines whether or not a backward feed command is included in the print command (step S12).

If the CPU 51' determines that the backward feed command is included in the print command, the CPU 51' controls the actuator 61 to move the BF guide 30 from a standby position to a predetermined position for allowing backward feeding to be performed (step S13). The standby position is the position at which the projecting portion 30*a* of the BF guide 30 does not project toward the conveying path beyond the fixed blade 12. More specifically, at this position, the BF guide 30 does not affect the movement of the movable blade 13 in the process of cutting the recording paper 100, in other words, the BF guide 30 is behind the area in which the movable blade 13 slides.

The predetermined position for allowing backward feeding to be performed is the position at which the projecting portion 30*a* of the BF guide 30 projects toward the conveying path beyond the cutting edge of the fixed blade 12. This position is preferably set to a position where an edge of the BF guide 30 near the fixed blade 12 projects toward the conveying path beyond the fixed blade 12. When not only the projecting portion 30*a* of the BF guide 30 but also the edge of the BF guide 30 near the fixed blade 12 projects toward the conveying path beyond the fixed blade 12, the amount of projection of the projecting portion 30*a* can be increased. Therefore, the downstream connected recording paper 101 can be more effectively prevented from entering and being stuck in the movable-blade receiving area.

After the BF guide 30 is moved from the standby position to the predetermined position by the actuator controller 57, the CPU 51' controls the platen controller 54 so as to feed the recording paper 100 forward (step S14), and stops the conveyance of the recording paper 100 when the amount of forward feeding reaches the first predetermined amount (step S15). After the forward feeding of the recording paper 100 is stopped, the CPU 51' controls the platen controller 54 so as to feed the recording paper 100 backward (step S16), and stops the conveyance of the recording paper 100 when the amount of backward feeding reaches the second predetermined amount (step S17).

Then, the CPU 51' controls the actuator 61 so as to move the BF guide 30 to a position where the BF guide 30 serves the function thereof but does not affect the printing operation (step S18). The position to which the BF guide 30 is moved in this step is the position where the projecting portion 30*a* of the BF guide 30 projects toward the conveying path beyond the fixed blade 12 but the edge of the BF guide 30 near the fixed blade 12 does not project toward the conveying path beyond the fixed blade 12. In other words, this position is the same as the position illustrated in FIGS. 7A to 7D.

Subsequently, the head controller 55 causes the thermal head 10 to generate heat at a predetermined position while the platen controller 54 feeds the recording paper 100 forward at a predetermined speed, so that color is developed in a thermal layer of the recording paper 100 (step S19). When the printing operation is completed, the CPU 51' determines whether or not backward feeding has been performed by the platen controller 54 (step S20). If it is determined that backward feeding has been performed, the CPU 51' controls the actuator 61 so as to return the BF guide 30 to the standby position (step S21). Instead of determining whether or not backward feeding has been performed, whether or not the BF guide 30 is at the standby position can be determined by the sensor controller 58.

Lastly, the cutter controller 56 controls the movement of the movable blade 13 to cut the recording paper 100 (step S22). If the CPU 51' determines that the backward feed command is not included in the print command in step S12, the process jumps to step S19. In this case, it is determined that backward feeding has not been performed in step S20. Therefore, step S21 is skipped.

As described above, in the case where the BF guide 30 is moved by using the actuator 61, the amount by which the BF guide 30 is moved can be adjusted. When the recording paper 100 is fed backward, the effect of the projecting portion 30*a* increases as the amount of projection thereof with respect to the fixed blade 12 increases. However, if the amount of projection of the projecting portion 30*a* is excessively increased, there is a risk that the recording paper 100 that is being conveyed will be blocked by the BF guide 30 in the printing operation.

In the case where the actuator 61 is used, the BF guide 30 is provided with a dedicated driving source. Therefore, the amount of projection of the projecting portion 30*a* can be increased when the recording paper 100 is fed backward, and the BF guide 30 can be moved to a position where the BF guide 30 does not block the recording paper 100 when the printing operation is performed. In the printing operation, the BF guide 30 may be moved to a position where the recording paper 100 that is being conveyed moves onto the inclined surface 30*e* of the BF guide 30, as illustrated in FIG. 7D. In such a case, the recording paper 100 is conveyed along the inclined surface 30*e* of the BF guide 30. Therefore, the recording paper 100 can be smoothly conveyed.

In the above-described embodiment, the printer including the separate-type cutter mechanism in which the movable blade 13 is provided at the main body and the fixed blade 12 is provided at the rear cover 15 is explained as an example. However, the present invention is not limited to this. For example, the present invention may also be applied to a printer in which both the fixed blade 12 and the movable blade 13 are provided at one of the main body and the rear cover 15.

In addition, in the above-described embodiment, the partial cutting process in which a central portion of the recording paper 100 is left uncut is described. However, the position of the uncut portion 102 is not limited to the central position. For example, a portion at an end of the recording paper 100 in the width direction may instead be left uncut. Alternatively, the recording paper 100 may be left uncut at two positions by using a movable blade 13 having a W-shaped cutting edge and stopping the sliding of the movable blade 13 immediately before end portions of the W-shaped cutting edge of the movable blade 13 reach the fixed blade 12.

In addition, in the printer explained in the above-described embodiment, the movable blade 13 is provided at the printing-surface side of the recording paper 100 and the fixed blade 12 is provided at the non-printing-surface side of the recording paper 100. However, the arrangement of the fixed blade 12 and the movable blade 13 may be opposite to the above-described arrangement. In such a case, the BF guide 30 is provided at the printing-surface side of the recording paper 100 together with the fixed blade 12.

The above-described embodiment is merely an example in which the present invention is implemented, and is not intended to limit the technical scope of the present invention. The present invention can be implemented in various ways without departing the spirit and main features of the present invention.

What is claimed is:

1. A printing apparatus with a cutter mechanism, comprising:

a conveying path along which a roll-type recording paper is conveyed;

conveying means that conveys the recording paper along the conveying path;

printing means that prints on the recording paper that is conveyed along the conveying path;

cutting means including a fixed blade and a movable blade that are disposed so as to be opposed to each other across the conveying path;

a movable paper-conveyance guiding member provided in a movable-blade receiving area into which the movable blade slides in a process of cutting the recording paper, the paper-conveyance guiding member including a projecting portion that projects toward the conveying path beyond a cutting edge of the fixed blade when the cutting process is not performed, the paper-conveyance guiding member comprising two guide members forming a V-shape through rotation when the cutting process is performed so that the paper-conveyance guiding member is moved away from the conveying path when the cutting process is performed; and a controller configured to control the conveying means to feed the recording paper forward toward a downstream side in a conveying direction by a first predetermined amount and then feed the recording paper backward toward an upstream side in the conveying direction by a second predetermined amount during the time from when the recording paper is cut to when a printing operation is started.

2. The printing apparatus according to claim 1, further comprising: a paper-conveying-locus regulating member positioned downstream of the paper-conveyance guiding member in a conveying direction, the paper-conveying locus regulating member including an inclined surface that is inclined from an upstream side toward a downstream side in the conveying direction, an upstream portion of the inclined surface being on the movable-blade side relative to the position of the projecting portion of the paper-conveyance guiding member when the cutting process is not performed, and a downstream portion of the inclined surface being on the fixed-blade side relative to the position of the projecting portion of the paper-conveyance guiding member when the cutting process is not performed.

3. The printing apparatus according to claim 1, wherein the paper-conveyance guiding member includes an inclined surface gradually sloping from an edge of the inclined surface near the fixed blade toward the projecting portion provided downstream in a conveying direction.

4. The printing apparatus according to claim 1, wherein a small gap is provided between the paper-conveyance guiding member and the fixed blade, a dimension of the gap in a thickness direction being larger than the maximum paper thickness of the recording paper for which the operation of the printing apparatus can be guaranteed.

5. The printing apparatus according to claim 1, wherein the paper-conveyance guiding member is urged by a spring such that the projecting portion projects toward the conveying path beyond the cutting edge of the fixed blade when the cutting process is not performed, and is moved away from the conveying path by being pushed by the movable blade that slides in the movable-blade receiving area when the cutting process is performed.

* * * * *